United States Patent [19]

Tada

[11] 4,249,506

[45] Feb. 10, 1981

[54] IGNITION DEVICE FOR INTERNAL COMBUSTION ENGINE

[75] Inventor: Yasuo Tada, Himeji, Japan

[73] Assignee: Mitsubishi Denki Kabushiki Kaisha, Tokyo, Japan

[21] Appl. No.: 84,165

[22] Filed: Oct. 12, 1979

[30] Foreign Application Priority Data

Nov. 8, 1978 [JP] Japan ..... 53/153912[U]

[51] Int. Cl.[3] ..... F02P 1/00

[52] U.S. Cl. ..... 123/618; 123/643

[58] Field of Search ..... 123/148 E, 148 CC, 117 R, 123/148 CB; 324/173, 174; 307/354, 357; 328/31

[56] References Cited

U.S. PATENT DOCUMENTS

| | | | |
|---|---|---|---|
| 3,938,490 | 2/1976 | Snyder | 123/148 E |
| 3,991,733 | 11/1976 | Harris | 123/148 E |
| 4,153,850 | 5/1979 | Bover | 123/148 E |

*Primary Examiner*—Ronald B. Cox

*Attorney, Agent, or Firm*—Oblon, Fisher, Spivak, McClelland & Maier

[57] ABSTRACT

An ignition device for an internal combustion engine comprises two signal generator coils for generating the output having steep variation from positive (or negative) peak value to negative (or positive) peak value by corresponding to the ignition timing of the engine. The two signal coils are serially connected in reverse polarity and the output terminals of the generator coils are connected in parallel to a circuit in which two rectifying elements are serially connected in reverse polarity. The joint between the two generator coils is connected to the joint between the two rectifying elements. The output terminals of the two generator coils are connected to the two input terminals of a differential amplifying circuit and the output of the differential amplifying circuit is given as input signal of the ignition circuit. Variation of the ignition timing caused by variation of the rotating speed of the signal generator can be decreased and the ignition device is stable against the external noise and the noise formed between the generator coils.

1 Claim, 7 Drawing Figures

IGNITION DEVICE FOR INTERNAL COMBUSTION ENGINE

BACKGROUND OF THE INVENTION

1. Field of the Invention

The present invention relates to an ignition device for an internal combustion engine, especially an ignition device of an engine having even number cylinders using a differential amplifying circuit.

2. Description of the Prior Arts:

In an internal combustion engine, the engine is highly affected by characteristics of an ignition system especially an ignition timing characteristic of an ignition system. The effectiveness of an engine is decided by the ignition timing characteristics.

However, in the convention ignition device having even number cylinders using a magnet type signal generator and a differential amplifying circuit, the engine is highly affected by variation of waveform to the rotation of the signal output of the magnet type signal generator and the ignition timing characteristics required for the engine has not been given.

Referring to FIGS. 1 to 3, the conventional system will be illustrated.

In FIG. 1, the reference numeral (1) designates a generator coil of a signal generator which is connected in parallel to a serially connected constant voltage diodes (2), (3) in reverse polarity. The output terminals of the col (1) are respectively connected through each resistor (4), (5) to (+), (−) input terminals of a differential amplifying circuit (6). The output terminals of the differential amplifying circuit (6) are respectively connected to each input terminal of an "AND" circuit (7) and a "NAND" circuit (8). The output terminal of the "AND" circuit (7) is connected to a base of a transistor (11). The base and the collector of the transistor (11) are respectively connected through each resistor (9), (10) to a power source ($V_B$). The emitter of the transistor (11) is grounded. The collector of the transistor (11) is connected to a base of Darlington transistor (12). The emitter of the transistor (12) is grounded and the collector of the transistor (12) is connected through a primary winding (14) of an ignition coil (13) to the power source ($V_B$). The output terminal of the secondary winding (15) of the ignition coil (13) is connected to a plug of an engine (not shown). The output terminal of the "NAND" circuit (8) is connected to transistors (18), (19) and resistors (16), (17) and an ignition coil (20) in the same manner.

FIG. 2 is a schematic view of the signal generator wherein the reference numeral (25) designates a pick-up comprising the coil (1), a magnet (26) and a core (27) and the reference numeral (28) designates an inductor.

Referring to FIG. 3 of waveforms in operation, the operation of the circuit having said structure will be illustrated.

When a engine is rotated and the output $V_o$ of the generator coil (1) has the waveform shown by the full line in FIG. 3 and the operation level of the differential amplifying circuit (6) comprising the resistors (4), (5) is given as $V_s$, the output of the A part is shifted to the "H" level at the time $t_1$ and is shifted to the "L" level at the time $t_2$. By the operation of the differential amplifying circuit (6), the performances of the "AND" circuit (7) and "NAND" circuit (8) are given as B and C in FIG. 3.

When the output of the differential amplifying circuit (6) is in "H" level, the output of the "AND" circuit (7) is in "H" level and the output of the "NAND" circuit (8) is in "L" level. When the output of the differential amplifying circuit (6) is in "L" level, the output of the "AND" circuit (7) is in "L" level and the output of the "NAND" circuit (8) is in "H" level. The transistor (11) is turned on during the "H" level of the output of the "AND" circuit (7) whereas it is turned off during the "L" level of the output of the "NAND" circuit (8). By the performance, the transistor (12) is operated so as to feed or to break the current shown in FIG. 3 through the primary winding of the ignition coil (13).

When the transistor (11) is turned on, the transistor (12) is turned off to break the current. When the transistor (11) is turned off, the transistor (12) is turned on to feed the current.

A spark voltage shown in FIG. 3F is generated in the secondary winding (15) of the ignition coil (13) during the breaking of the current.

The transistors (18), (19) connected after the "NAND" circuit (8) are performed as the performances of the transistors (11), (12).

These operations are described in the relations of the inputs and the outputs of these circuits.

The spark voltage is applied to the ignition coil (13) at the time $t_1$ in the positive wave of the output $V_o$ of the dynamo coil (1). The spark voltage is applied to the ignition coil (20) at the time $t_2$ in the negative wave of the output $V_o$. When the rotary speed of the engine increases, the output $V_o$ of the generator coil (1) increases to give the waveform shown by the dotted chain line of the output $V_o$ in FIG. 3.

When the positive wave is formed from the initiation facing the projection (a) of the inductor (28) to the core (27) by the rotation of the inductor (28) to the finish, the negative wave is formed from the initiation of departing the projection to the finish. In general, when the magnetic variation angle caused in the relation of the inductor (28) and the core (27) is larger than the rotary angle, the output wave caused in the generator coil is a slack curve. Thus, the output wave of the above-mentioned structure is the slack curve. Therefore, as shown in FIG. 3, the level of the differential amplifying circuit (8) comprising the resistors (4), (5) is $V_s$. The times $t_1$ and $t_2$ for shifting the level of the differential amplifying circuit (6) from "H" to "L" or from "L" to "H" are changed to $t_1'$ and $t_2'$ by leading for the angle $\theta$.

In order to decrease the angle $\theta$, the width of the projection (a) of the inductor (28) is decreased as shown by the dotted line in FIG. 2, the interval of the formation of the positive wave and the negative wave is shorten and a desired ignition interval is not given and the rising of the negative wave is steep but the rising of the positive wave is slack. Thus, the projection shown by the full line of FIG. 2 is used. The spark voltages of the ignition coils (13), (20) are generated in leading for the angle $\theta$ whereby the ignition time lead for the angle $\theta$. The overvoltage output of the dynamo coil (1) is clipped by the constant voltage diodes (2), (3). The ignition timing characteristics of the engine are usually set by a mechanical or electrical system. Thus, the variation of the ignition timing caused by the signal generator adversely affect to the function of the engine. However, when the positive and negative signal output required as the input for the differential amplifying circuit are obtained by one generator coil, the ignition timing is disadvantageously varied by the effect of the output waveform of the generator coil.

SUMMARY OF THE INVENTION:

It is an object of the present invention to overcome said disadvantages and to provide an ignition device for an internal combustion engine imparting a desired ignition timing characteristics required for an engine.

In accordance with the ignition device for an internal combustion engine of the present invention, two signal generator coils which correspond to ignition timing of an engine and which generate the output having steep variation from positive (or negative) peak value of the output wave to negative (or positive) peak value, are serially connected in reverse polarity, and the output terminals of the serially connected generator coils are connected in parallel to a circuit in which two serially connected rectifying elements in reverse polarity, and a joint between the two generator coils is connected to a joint between the two rectifying elements and the output terminals of two serially connected generator coils are respectively connected to two input terminals of the differential amplifying circuit whereby the output of the differential amplifying circuit is given as the input signal for the ignition circuit.

Figure 4:
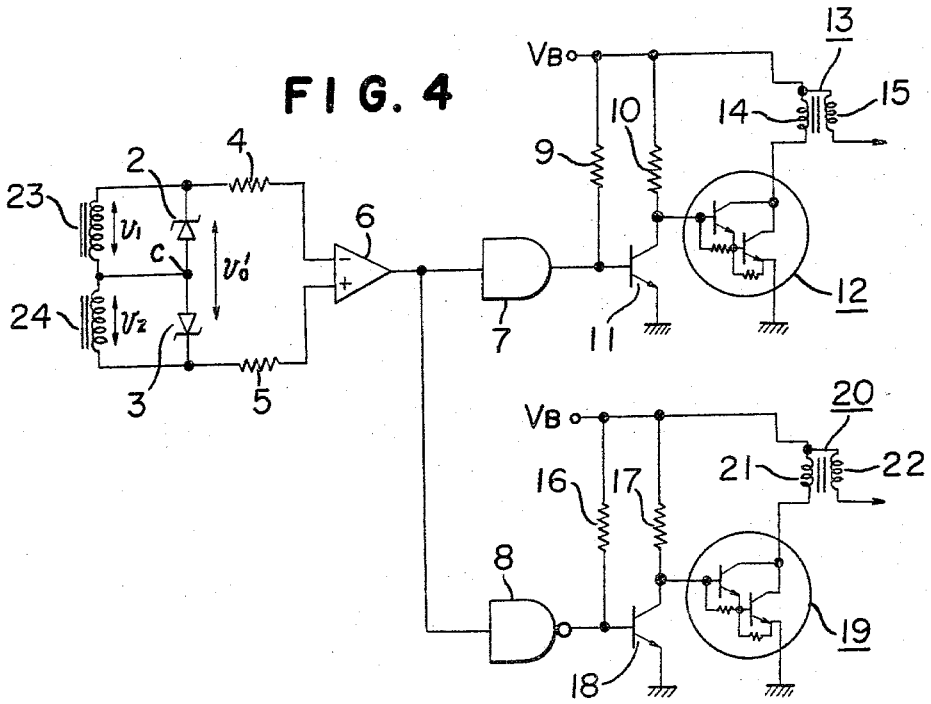
FIG. 4 is an electric circuit diagram of one embodiment of the present invention.
Figure 5:
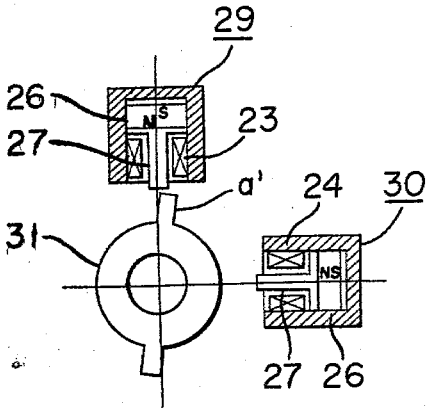
FIG. 5 is a schematic view of a signal generator used in the circuit of FIG. 4.
Figure 6:
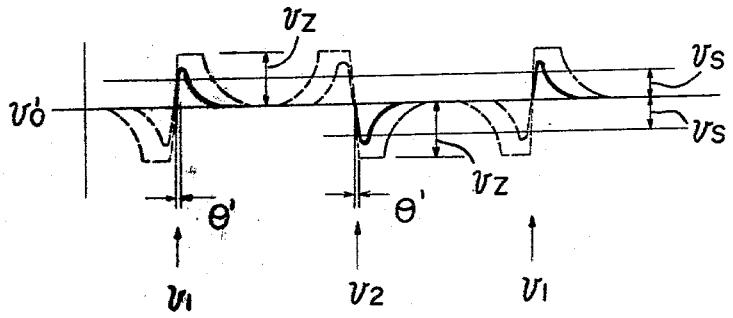
FIG. 6 shows waveforms in the operation of the circuit of FIG. 4.

DETAILED DESCRIPTION OF THE PREFERRED EMBODIMENTS:

Referring to FIGS. 4 to 6, one embodiment of the present invention will be illustrated.

In FIG. 4, the reference numerals (23), (24) respectively designate generator coils of the signal generators for respectively detecting ignition timing for each cylinder of the engine. The generator coils (23), (24) are serially connected and two constant voltage diodes (2), (3) (reference diodes) serially connected in reverse polarity are connected to the output terminals of the generator coils (23), (24). The joint of the generator coils (23), (24) is connected to the joint of the constant voltage diodes (2), (3). The input terminal of the differential amplifying circuit (6) is connected through the resistors (4), (5) to the output terminal of the serially connected generator coils (23), (24).

FIG. 5 is a schematic view of the signal generator wherein the reference numeral (29) designates a first pick-up comprising the generator coil (23), the magnet (26) and the core (27); and (30) designates a second pick-up comprising the generator coil (24), the magnet (26) and the core (27), and (31) designates an inductor.

The other references designate identical or corresponding parts in the conventional device, and accordingly, the description for these parts is eliminated.

Figure 3:
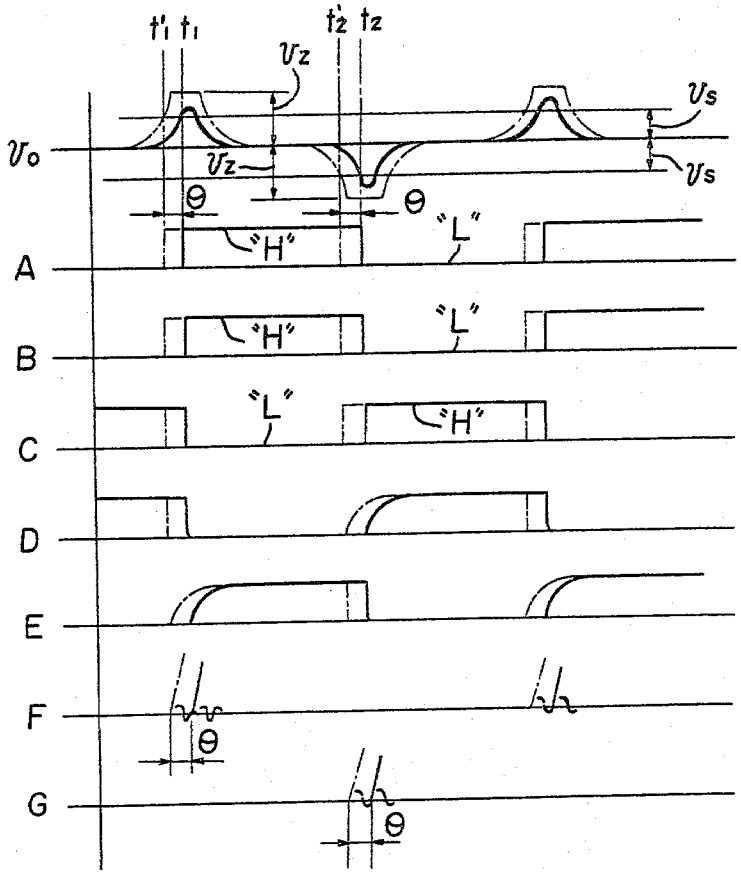
FIG. 3 shows waveforms in the operations of the circuit of FIG. 1.

In the structure, when the inductor (31) is turned to face the projection (a') of the inductor (31) to the core (27) of the pick-ups (29), (30), the output is formed by the generator coils (23), (24). The waveform having steep variation from the positive (negative) peak value to the negative (positive) peak value shown in FIG. 6. is formed as the output wave because the magnetic variation angle is relatively smaller than the rotation angle. Thus, in the output waves of the generator coils (23), (24) as shown by $V_1$ and $V_2$ in FIG. 6, the negative wave is formed and then, the positive wave having steep rising is formed in the generator coil (23) whereas the positive wave is formed and then, the negative wave having steep rising is formed in the generator coil (24). The output $V_o'$ obtained by composing these waves through the constant voltage diodes (2), (3) should alternately generate the positive wave and the negative wave which have steep rising as shown by the full line in FIG. 6. In such output having steep rising, when the rotating speed of the engine is increased and the rotating speed of the signal generator is increased to increase outputs of the generator coils (23), (24), the waveform shown by the dotted chain line in FIG. 6 is given. Thus, the angle is shifted for $\theta'$ when the level $V_s$ of the differential amplifying circuit (6) is constant. It is clearly understood from the drawings that $\theta'$ is remarkably smaller than $\theta$ shown in FIG. 3. Thus, the variation of the timing of the spark voltage formed in the ignition coils (13), (20) shown in FIG. 4 is smaller.

Figure 1:
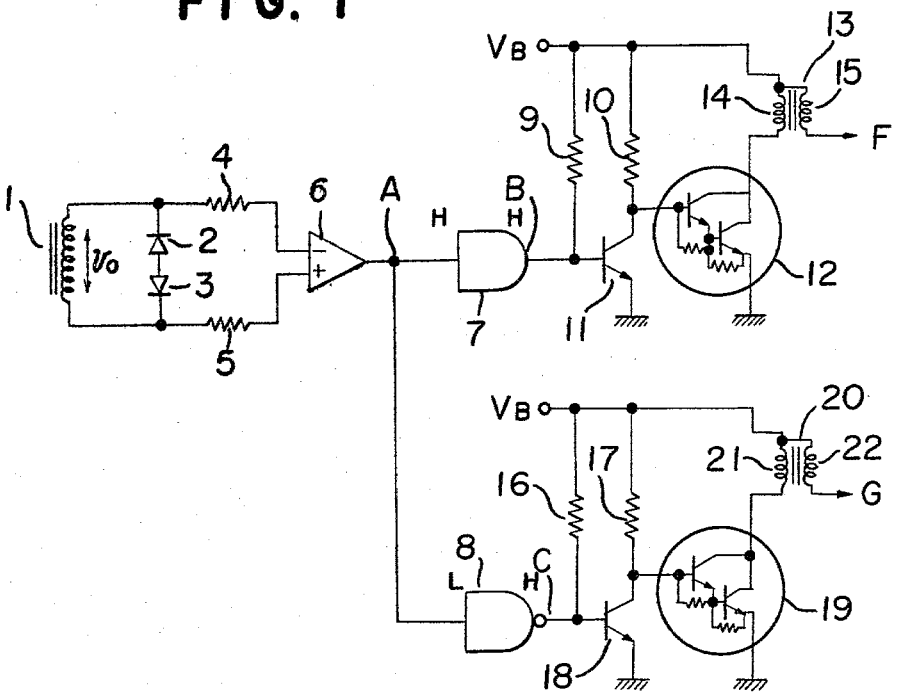
FIG. 1 is an electric circuit diagram of the conventional device.
Figure 2:
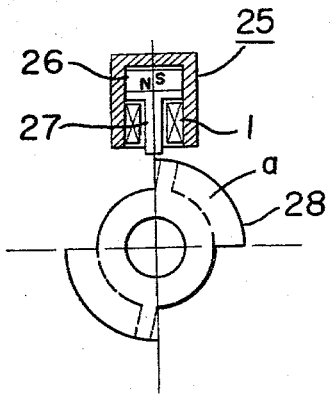
FIG. 2 is a schematic view of a signal generator used in the circuit of FIG. 1.

When the condition for forming the output voltages of the generator coils (23), (24) shown in FIG. 4 is varied from the waveform shown in FIG. 6, for example, the generator coil (23) is connected to form it from the negative wave to the positive wave as $V_1$ in FIG. 6 and the generator coil (24) is also connected to form it from the negative wave to the positive wave as $V_1$ in FIG. 6, it is clear that the angle shifting from $t_1$ to $t_1'$ by increasing the rotating speed is $\theta'$ but the angle shifting from $t_2$ to $t_2'$ is $\theta$. Thus, in the circuit shown in FIG. 1, the combination of the generator coils (23), (24) and the constant voltage diodes (2), (3) should give the composite output shown in FIG. 6.

In the circuit shown in FIG. 4, when the constant voltage diodes (2), (3) are not connected, both of the positive and negative waves of the generator coils (23), (24) are given as inputs of the differential amplifying circuit (6) and a desired performance is not attained, and accordingly, the constant voltage diodes (2), (3) are connected.

Figure 7:
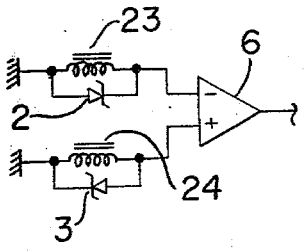
FIG. 7 is an electric circuit diagram which is not practically applicable in the modification of the circuit of FIG. 4.

It is possible to obtain the effect of the present invention by combining the other diodes instead of the constant voltage diodes (2), (3). Furthermore, when the outputs of the generation coils (23), (24) are separately fed to the input terminals (+), (−) of the differential amplifying circuit (6) as shown in FIG. 7, the variation of the ignition timing can be decreased as that of the present invention. However, outputs of the generator coil (23), (24) are fed through the grounding circuit to the differential amplifying circuit (6), whereby it is weak to external noise.

In the structure of the generator shown in FIG. 5, each corresponding generator coil noise output is caused, when the projection (a) of the inductor (31) faces to the core (27) of the pick-ups (29), (30). In the case of FIG. 7, the effect is not eliminated to feed it as the input of the differential amplifying circuit whereby an erroneous performance is caused. Therefore, in the ignition device of the present invention, two signal generator coils which correspond to ignition timing of an engine and which generate the output having steep variation from positive (or negative) peak value of the output wave to negative (or positive) peak value, are serially connected in reverse polarity, and the output terminals of the serially connected generator coils are connected in parallel to a circuit in which two serially connected rectifying elements in reverse polarity, and a joint between the two generator coils is connected to a joint between the two rectifying elements and the output terminals of two serially connected generator coils are respectively connected to two input terminals of the differential amplifying circuit, whereby the output of the differential amplifying circuit is given as the input signal for the ignition circuit.

As above-described, in accordance with the present invention, the two signal generator coils which generate the output having steep variation from positive (or negative) peak value of the output wave to negative (or positive) peak value, are serially connected in reverse polarity, and the output terminals of the serially connected generator coils are connected in parallel to the circuit in which the two serially connected rectifying element in reverse polarity and the joint between the two generator coils is connected to the joint between the two rectifying elements and the output terminals of the two serially connected generator coils are respectively connected to two input terminals of the differential amplifying circuit. Accordingly, the variation of the ignition timing caused by the variation of the rotating speed of the signal generator can be decreased and the ignition device is stable against the external noise and the noise caused between the two generator coils.

I claim:

1. In an ignition device for an internal combustion engine, an improvement characterized in that two signal generator coils which correspond to ignition timing of an engine and which generate the output having steep variation from positive (or negative) peak value of the output wave to negative (or positive) peak value, are serially connected in reverse polarity, and the output terminals of the serially connected generator coils are connected in parallel to a circuit in which two serially connected rectifying elements in reverse polarity, and a joint between the two generator coils is connected to a joint between the two rectifying elements and the output terminals of two serially connected generator coils are respectively connected to two input terminals of the differential amplifying circuit whereby the output of the differential amplifying circuit is given as the input signal for the ignition circuit.

* * * * *